US006405742B1

(12) United States Patent
Driscoll

(10) Patent No.: US 6,405,742 B1
(45) Date of Patent: Jun. 18, 2002

(54) PORTABLE SUN SHADE

(76) Inventor: James J. Driscoll, 5086 Barnard St., Simi Valley, CA (US) 93063

( * ) Notice: Subject to any disclaimer, the term of this patent is extended or adjusted under 35 U.S.C. 154(b) by 0 days.

(21) Appl. No.: 09/618,072

(22) Filed: Jul. 17, 2000

Related U.S. Application Data

(60) Provisional application No. 60/144,207, filed on Jul. 19, 1999.

(51) Int. Cl.[7] ..... E04H 15/02

(52) U.S. Cl. ..... 135/96; 135/20.1; 135/42

(58) Field of Search ..... 135/15.1, 20.1, 135/42, 96

(56) References Cited

U.S. PATENT DOCUMENTS 581,691 A * 5/1897 Buchanan et al. ..... 135/90
1,018,522 A * 2/1912 Savage ..... 135/151
3,765,434 A * 10/1973 Riggs ..... 135/20 A
4,082,102 A * 4/1978 Heuer ..... 135/5 R
4,100,633 A * 7/1978 Pintos ..... 5/337
5,096,257 A * 3/1992 Clark ..... 297/184
5,579,797 A * 12/1996 Rogers ..... 135/90
5,743,283 A * 4/1998 Horvath ..... 135/16

* cited by examiner

*Primary Examiner*—Curtis A. Cohen
*Assistant Examiner*—Khoa Tran
(74) *Attorney, Agent, or Firm*—Roger A. Marrs

(57) ABSTRACT

A sun shade having an elongated member laterally supported from the end of a pole by a universal joint permitting rotational and angular movement of the member with respect to the longitudinal axis of the pole itself. The pole includes a telescoping arrangement whereby the pole can be lengthened or shortened at the discretion of the user. The end of the pole opposite to its end carrying the member includes a universal mount connected to a firm anchor or support by a suitable clamp.

2 Claims, 2 Drawing Sheets

10
11
12
13
14
15
16
17
18
20
21
22
23
24
25
26
27
28
30
31
32
33
34
35
36
40
41
42
43
44
45

50
51
52
53
54
55
56
57
58
60
61
62
63
64
65
66
68
69
70
71
72
73
74
75
76
77

PORTABLE SUN SHADE

Priority claimed on Ser. No. 60/144,207 filed Jul. 19, 1999.

BACKGROUND OF THE INVENTION

1. Field of the Invention

The present invention relates to the field of sun shades, and more particularly to a novel sun shade having an extended and elongated panel supported on the end of a pole by a universal joint and which further includes means for detachably connecting or supporting the pole on such items as lawn chairs, window ledges, ground support or the like.

2. Brief Description of the Prior Art

In the past, it has been the conventional practice to employ sun shades which are of a large area so that a maximum amount of shade is produced beneath an umbrella, stretched membrane or diaphragm or flexible cover material. Such shades, such as umbrellas; usually provide elaborate mechanisms for opening and closing the sheet material serving as a shade and usually such prior umbrellas are supported in cement anchors or are supported through openings in the center of a table or other support mechanisms.

Problems and difficulties have been encountered with conventional shade umbrellas and the like which stem from the fact that the shade cover itself is not adjustable throughout a variety of positions so as to be responsive to movement of the sun over the earth's surface which causes a need for change in shading area. Even if conventional umbrellas include pivots in the supporting pole, the pivots are unidirectional and permit only raising or lowering of the shade in either a vertical direction or at an angle, and such pivots are not of a universal nature. Other difficulties are encountered because the conventional shades, such as umbrellas, are intended to cover a wide shaded area and are not applicable for use in connection with individuals who wish to spot shade portions of their body, such as the face or even solely the eye area. In such situations, the sunbather wishes to have the sun cover as much of his body as possible except for the very small portion to be shaded.

Therefore, a long-standing need has existed to provide a sunshade which can readily be used for spot shading on a sunbather's body and which may include a rigid shade panel which is mounted on a pole by a universal joint means and which may be detachably supported on a variety of furniture, equipment or even on the ground.

SUMMARY OF THE INVENTION

The above problems and difficulties are avoided by the present invention which provides a novel sun shade having an elongated member or panel which is laterally supported from the end of a pole by means of a universal joint which permits not only rotational movement of the member or panel but permits angular movement with respect to the longitudinal axis of the pole itself. The pole includes a telescoping arrangement so that the pole may be lengthened or shortened at the discretion of the user. The end of the pole opposite to its end carrying the panel includes a universal mount connected to a support means for supporting the sun shade from lawn furniture, window sills, such as the window ledge of an automobile, or which may be supported directly on the ground. Such a means may include a suitable clamp or may include a spike or ground support. A feature of the invention involves providing a storage cavity in the end of the post for storing a spike that may be used as an alternate support to a clamp for ground support purposes. Means are also provided for attaching a clamp support to the arm of furniture such as lawn furniture so that marring of the arm will not occur and scratching as well as damage is avoided. Such means may include rollers whereby the entire assembly can be moved on the arm to a selected position. The clamp and/or universal joint securing the end of the post to the arm of furniture may be detachably connected from the post so as to permit access to the compartment for storing the support spike. The support spike can be removed from the compartment and then threadably attached to the end of the post.

Therefore, it is among the primary objects of the present invention to provide a novel sun shade for sunbathing use which will selectively shade a portion of a sunbather's body while permitting the sun's rays to be applied against a major portion of a sunbather's skin.

Another object of the present invention is to provide a novel sun shade which will selectively shade a portion of a sunbather's body from the sun's rays while permitting the major body area to receive the sun rays.

Still a further object of the present invention is to provide a novel sun shade which includes a rigid elongated member or panel which is attached to a post by a universal joint so that the panel may be articulated to a variety of selected positions for selectively shading a portion of a sunbather's body.

A further object resides in providing a portable sun shade which includes an extendable post having a variety of support means for detachably connecting the sun shade to furniture, mobile vehicles such as autos or golf carts, and, alternately, which may be supported directly on the ground.

Other objects and features reside in providing an elongated telescoping post for supporting a rigid sun shade by means of a universal joint at one end of the post while employing a second universal joint for supporting a clamp for detachably connecting the post to a variety of supports.

BRIEF DESCRIPTION OF THE DRAWINGS

The present invention may be understood with reference to the following drawings.

DESCRIPTION OF THE PREFERRED EMBODIMENT

Figures 1, 2, 3, 4:
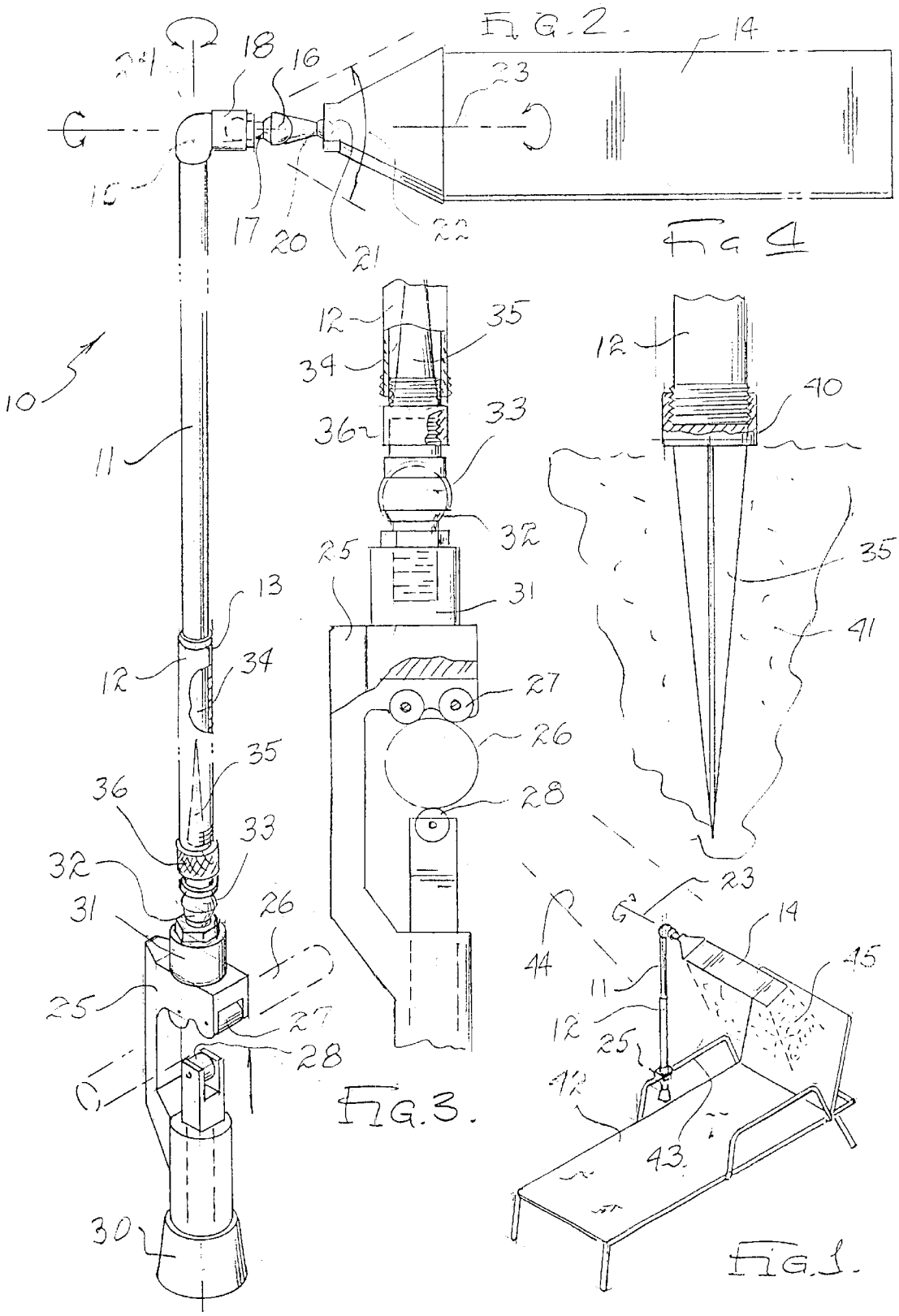
FIG. 1 is a perspective view illustrating the novel sun shade.
FIG. 2 is an enlarged perspective view of the sun shade illustrated in FIG. 1.
FIG. 3 is a fragmentary perspective view, partly in section.
FIG. 4 is an enlarged side elevational view.

Referring to FIG. 2, the present invention is illustrated in the general direction of arrow 10 which includes ah elongated post 11 supported in telescoping relationship with respect to a tube 12 which includes a twist retainer 13 adapted to hold the post 11 in any selected position along the length of tube 12. One end of the post 11 includes an elongated member or panel 14 which is carried on the end of the post by a fitting 15 and a universal joint having a socket portion 16 and a ball portion 17. A coupling 18 retains the universal joint on the end of the post 11. Furthermore, it can be seen that the end of the member or panel 14 is attached to the universal joint by means of a second pivoting arrangement of a universal type taking the form of a ball 20 retained in a socket 21. By means of the double universal joint, the angle of the member or panel 14 may be placed between the broken lines, as indicated by the arrow 22, as well as being adapted for rotation along an axis 23. Furthermore, rotation can occur about a longitudinal axis 24 so that full articulation of the member or panel 14 is obtainable.

FIG. 2 further illustrates a support means for the member or panel 14 as well as the post and tube 11 and 12 which takes the form of a clamp having a body 25 with an opening into which a support bar or tube 26 is received. Either a screw type clamp can be used in combination with the "C"-shaped clamp or, as illustrated, a pair of rollers such as roller 27 and a roller 28 may be employed for providing an interference type fit over the tube or rod 26. Preferably, a pair of rollers is provided on one side of the clamp with a single roller on the other side and the rollers are preferably composed of a resilient material such as plastic-like or rubberlike composition so that no marring or marking, scratching or the like will occur on the surface of the supporting rod or tube. The bottom of the clamp is provided with a cushion stop 30.

The clamp body 25 supports a universal joint or fitting carried on a knob 31. The fitting includes a ball 32 fitted into a socket 33 carried on the end of the tube 12. Therefore, an additional universal pivot or joint is provided for the post as well as the member or panel 14.

FIG. 2 also illustrates that the tube 12 may be hollow so as to provide a storage space 34 which is internal of the tube. An alternate supporting means, such as a spike 35, can be stored in the interior compartment when not in use. However, when it is desired to use the spike for ground support rather than use the C-shaped clamp or body 25, the spike can be removed from the compartment by disassembling the clamp from tube 12 by rotating a knurled threaded fitting 36.

Referring now in detail to FIG. 3, it can be seen that the C-clamp 25 supports the universal joint or fitting comprising ball 32 and socket 33 and that the clamp further supports the tube 12 and post 11. As illustrated, the ground spike 35 is within the storage compartment 34 and will remain in the compartment until use, as shown in FIG. 4. When it is desired to use the spike, the threaded fitting 36 is loosened and removed from the threaded connection with the bottom of tube 12 so that the spike 35 can be removed from compartment 34.

As shown in FIG. 4, once the spike has been removed from the compartment, the threaded end 40 of the spike 35 constitutes a threaded receptacle which receives the threaded end of tube 12. When fixedly attached, the spike 35 may then be projected into the ground or buried in the ground, which is represented by numeral 41.

Referring now in detail to FIG. 1, a typical illustration of usage is provided taking. the form of an outdoor lounge or lawn chair or couch 42 having arms such as arm 43. The clamp 25 is illustrated as being supported on the arm 43 substantially as shown in FIG. 2. The post 11 supporting the member or panel 14 can be raised or lowered since the post 11 is telescopically carried on the tube 12. The shade 14 can be rotated about axis 23 and/or pivoted about the universal joint in an angular direction, such as indicated by numeral 22 in FIG. 2. Sunrays approaching, as indicated by broken lines 44, are blocked by the member 14 and the shade area is very selective for anyone reclining on the couch or chair 42. The shade area is indicated broadly by numeral 45.

In view of the foregoing, it can be seen that the fully articulated shade member or panel 14 can be rotated or positioned into several orientations in order to provide a selected area of shading for a sunbather. Universal joints are provided at the connection between the support whether it be a spike or a clamp and further universal connection is provided between the post 11 member or panel 14. Positioning of the shade member is manually performed by the sunbather and choice of spike or clamp is made by the user. The user can readjust or reposition the shade member or panel periodically to follow sun position changes.

Figures 5, 6, 7, 8:
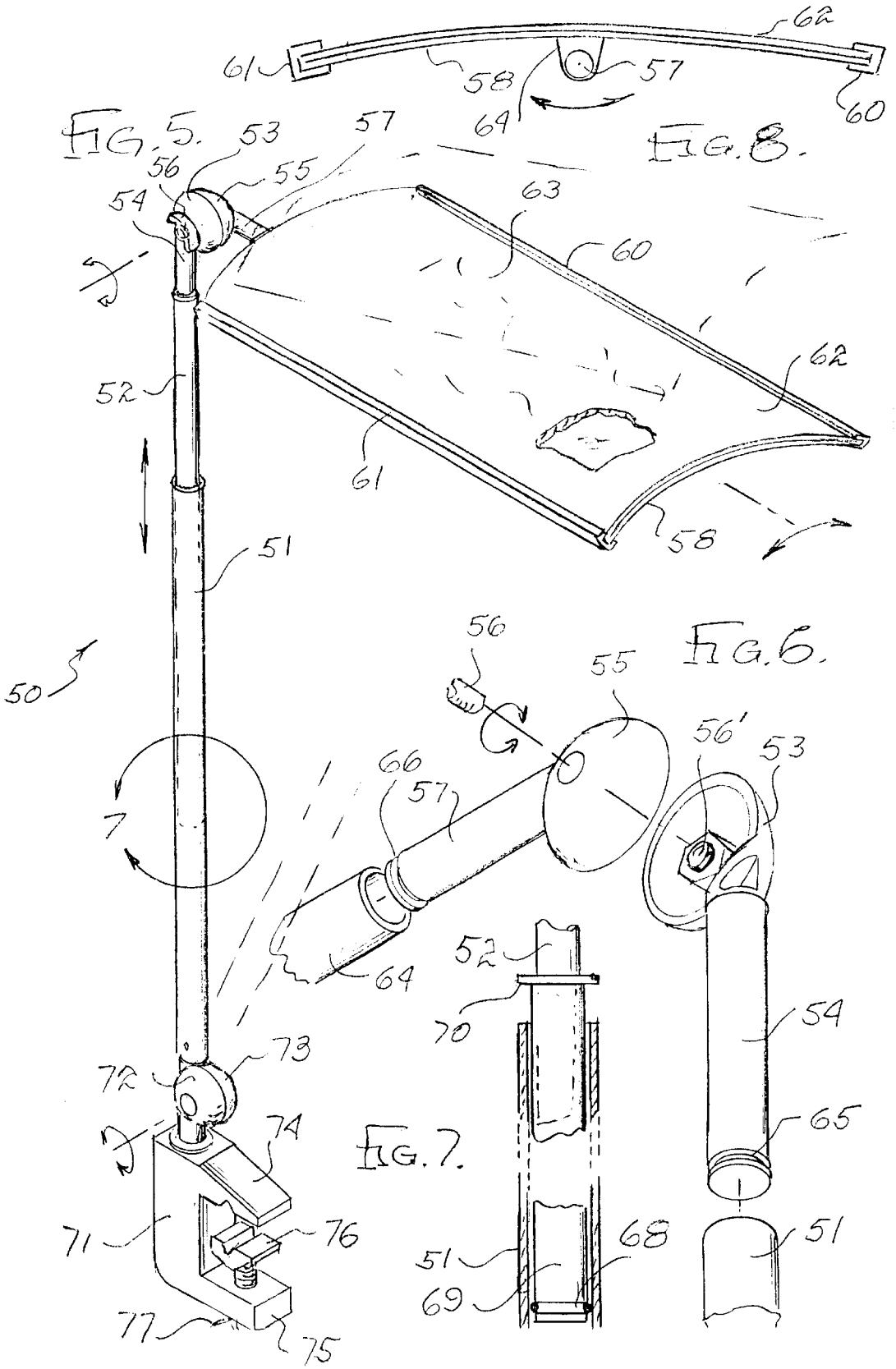
FIG. 5 is a perspective view of another version.
FIGS. 6, 7 and 8 are views of details relating to FIG. 5.

Referring to FIGS. 5–8, another version of the present invention is illustrated in the general direction of arrow 50 which includes an elongated, telescoping pole in a major length in tube 51 into which a rod 52 is movably displaced. Rod 52 in tube 51 is in telescoping relationship and the free end of rod 52 mounts a knuckle joint 53, having a stationary part 54, which a rotatable moving part 55 is attached and secured in place by means of any suitable fastening means such as a nut 56. The movable part 55 includes an element 57 which carries an elongated panel 58 thereon so that the panel outwardly projects in cantilevered fashion in a sideways or transverse relationship with respect to the telescoping pole. The opposite edges of the elongated panel 58 include a pair of rails 60 and 61 which are arranged in fixed, spaced-apart relationship and are open-ended so as to slidably and insertably receive a sheet of advertising material. The sheet is identified by numeral 62 and includes an exposed surface 63 on which advertising may be placed. Such a display may take the form of alpha/numeric representations, pictorial illustrations, graphic representations or the like. The rails 60 and 61 are also illustrated in FIG. 8, and it can be seen that the panel 58 is mounted for rotational movement on the element 57. Element 57 serves as a shaft on which the panel 58 is mounted by means of mount 64. Mount 64 is secured to the underside of panel 58 and rotates therewith on the shaft element 57.

In FIG. 6, it can be seen that the elements 54 and 57 include an O-Ring 65 and 66, each of which bear against the internal bore surface of the respective tube 51 and mount 64. FIG. 7 further illustrates that the lower end of rod 52 includes a seal 68 which is carried on the extreme end thereof and that the seal 68 engages with the surface of the bore of tube 51 when the end of rod 52 is inserted therein. The extreme end is identified by numeral 69. The rod 52 further includes a stop 70 which engages with the top of the tube 51.

FIG. 5 further illustrates that a clamping means taking the form of a C-Clamp 71 is carried on the end of tube 51 by means of a knuckle joint having a fixed portion 72 and a movable portion 73. The end of tube 51 is attached to the movable portion 73 in the manner similar to that described with respect to the mounting of fixed knuckle portion 56 to the rod 52. The C-Clamp 71 includes jaws 74 and 75 which are arranged in fixed, spaced-apart relationship so as to permit an adjustable element 76 to move between the opposite surfaces of the jaw for adjusting to a support structure or construction. The element 76 may move to the jaw 75 by manually turning a thumb screw 77.

Therefore, it can be seen that the panel 58 may be rotated with respect to the support pole and that rotation may be along the horizonal axis of shaft element 57 as shown in FIG. 8 and/or the panel 58 may be rotated along the axis of the knuckle 55 as well. The rod 52 may be raised or lowered with respect to the tube 51 and the tube 51 may be rotated in accordance with the knuckle portion 73 with respect to the fixed portion 72 on the clamp 71. Therefore, a person using the sun shade incorporating the present invention may adjust the shade as the sun moves during the day. The shade area provided by the panel 58 may be arranged so that only the eyes and face of the user are covered substantially as shown in FIG. 1.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An adjustable sun shade comprising:

a support pole having a pair of tubes arranged in adjustable length, telescoping relationship and having an upper and a lower end;

an elongated rigid panel having a greater length than the width and having a pair of spaced-apart rails, each rail defining a gap;

a first movable joint connecting the upper end of said support pole with said rigid panel for angular movement of the panel with respect to said support pole;

a second movable joint connecting said lower end of said support pole with an adjustable clamp;

said adjustable clamp for releasable coupling with a support structure;

a stationary fitting connecting with said first movable joint and second movable joint for allowing said panel to have multiple axes of rotation and an angular displacement in positioning said panel with respect to said support pole;

said first and second movable joints being spaced apart from each other on said support pole and said rigid panel is inserted between said gaps of said rails and retained thereby.

2. The sun shade defined in claim 1 wherein:

each of said movable joints are knuckle joints having a fixed portion and a rotatable portion;

said staionary fitting is fixed to said rotatable portion of said movable joint; and said fixed portion of said first movable joint is secured to said selected end of said support pole.

* * * * *